US007893946B2

(12) United States Patent
Wu et al.

(10) Patent No.: US 7,893,946 B2
(45) Date of Patent: Feb. 22, 2011

(54) COLOR TEMPERATURE CALIBRATION METHODS AND RELATED DEVICES

(75) Inventors: Yen-Hsing Wu, Hsin-Chu Hsien (TW); Chun-Hsing Hsieh, Hsin-Chu (TW); Chia-Hui Kuo, Chubei (TW)

(73) Assignee: Realtek Semiconductor Corp., Science Park, HsinChu (TW)

( * ) Notice: Subject to any disclaimer, the term of this patent is extended or adjusted under 35 U.S.C. 154(b) by 629 days.

(21) Appl. No.: 11/622,478

(22) Filed: Jan. 12, 2007

(65) Prior Publication Data

US 2007/0285433 A1 Dec. 13, 2007

(30) Foreign Application Priority Data

Jan. 13, 2006 (TW) ..... 95101491 A

(51) Int. Cl.
*G09G 5/02* (2006.01)

(52) U.S. Cl. ..... 345/590; 345/589; 345/593; 345/207; 382/167; 348/223.1; 348/655

(58) Field of Classification Search ..... None
See application file for complete search history.

(56) References Cited

U.S. PATENT DOCUMENTS

| | | | | |
|---|---|---|---|---|
| 6,611,249 | B1 | 8/2003 | Evanicky et al. | |
| 7,218,358 | B2 * | 5/2007 | Chen et al. | 348/658 |
| 7,446,779 | B2 * | 11/2008 | Ikeda et al. | 345/589 |
| 2003/0020736 | A1 | 1/2003 | Kimura | |
| 2005/0012867 | A1 | 1/2005 | Inamura | |
| 2008/0285851 | A1 * | 11/2008 | Wu et al. | 382/167 |

FOREIGN PATENT DOCUMENTS

| | | |
|---|---|---|
| TW | 510123 | 11/2002 |
| TW | 563092 | 11/2003 |
| TW | 588547 | 5/2004 |
| TW | I222330 | 10/2004 |
| TW | I246319 | 12/2005 |
| TW | 200601183 | 1/2006 |

* cited by examiner

*Primary Examiner*—Antonio A Caschera
(74) *Attorney, Agent, or Firm*—Winston Hsu; Scott Margo

(57) ABSTRACT

A color temperature calibration method for calibrating the color temperature of a display device according to a set of target chromaticity coordinate values, includes: measuring colors displayed by a plurality of display cells of the display device to generate at least a set of measurement chromaticity coordinate values; and adjusting at least a first gain value of the display device according to the set of target chromaticity coordinate values and the set of measurement chromaticity coordinate values; where the first gain value corresponds to the color of a first color channel of the display device; and the first color channel is one of the red color channel, green color channel and blue color channel.

17 Claims, 2 Drawing Sheets

COLOR TEMPERATURE CALIBRATION METHODS AND RELATED DEVICES

BACKGROUND OF THE INVENTION

1. Field of the Invention

The present invention relates to color calibration of display devices, and more particularly, to color temperature calibration methods and related devices.

2. Description of the Prior Art

As various kinds of multimedia applications become popular, it is usually needed to transmit video data between different devices by color video signals. To perform transmission of color video signals through the Internet or between computers, sRGB color space is introduced as a standard color space commonly utilized in the art. As a result, all display/output devices complying with sRGB color space standards may perform data interchange without introducing color distortion. In order to make a display device (such as an LCD monitor) sRGB-compatible, color temperature calibration becomes an issue when manufacturing the display device.

SUMMARY OF THE INVENTION

It is an objective of the claimed invention to provide color temperature calibration methods and related devices.

According to one embodiment of the claimed invention, a color temperature calibration method for calibrating the color temperature of a display device according to a set of target chromaticity coordinate values is disclosed. The color temperature calibration method comprises: measuring colors displayed by a plurality of display cells of the display device to generate at least a set of measurement chromaticity coordinate values; and adjusting at least a first gain value of the display device according to the set of target chromaticity coordinate values and the set of measurement chromaticity coordinate values; wherein the first gain value corresponds to the color of a first color channel of the display device; and the first color channel is one of the red color channel, green color channel and blue color channel.

According to one embodiment of the claimed invention, a color temperature calibration method for calibrating the color temperature of a display device according to a set of target chromaticity coordinate values is further disclosed. The color temperature calibration method comprises: displaying at least one color by a plurality of display cells of the display device, wherein the color is composed of red color, green color and blue color; measuring the color to generate at least a set of measurement chromaticity coordinate values; and adjusting at least a first color gain value of the color according to the set of target chromaticity coordinate values and the set of measurement chromaticity coordinate values.

According to one embodiment of the claimed invention, a color temperature calibration device for calibrating the color temperature of a display device according to a set of target chromaticity coordinate values is further disclosed. The color temperature calibration device comprises: a calorimeter for measuring colors displayed by a plurality of display cells of the display device to generate at least a set of measurement chromaticity coordinate values; and a control circuit, coupled to the calorimeter and the display device, for adjusting at least a first gain value of the display device according to the set of target chromaticity coordinate values and the set of measurement chromaticity coordinate values; wherein the first gain value corresponds to the color of a first color channel of the display device; and the first color channel is one of the red color channel, green color channel and blue color channel.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
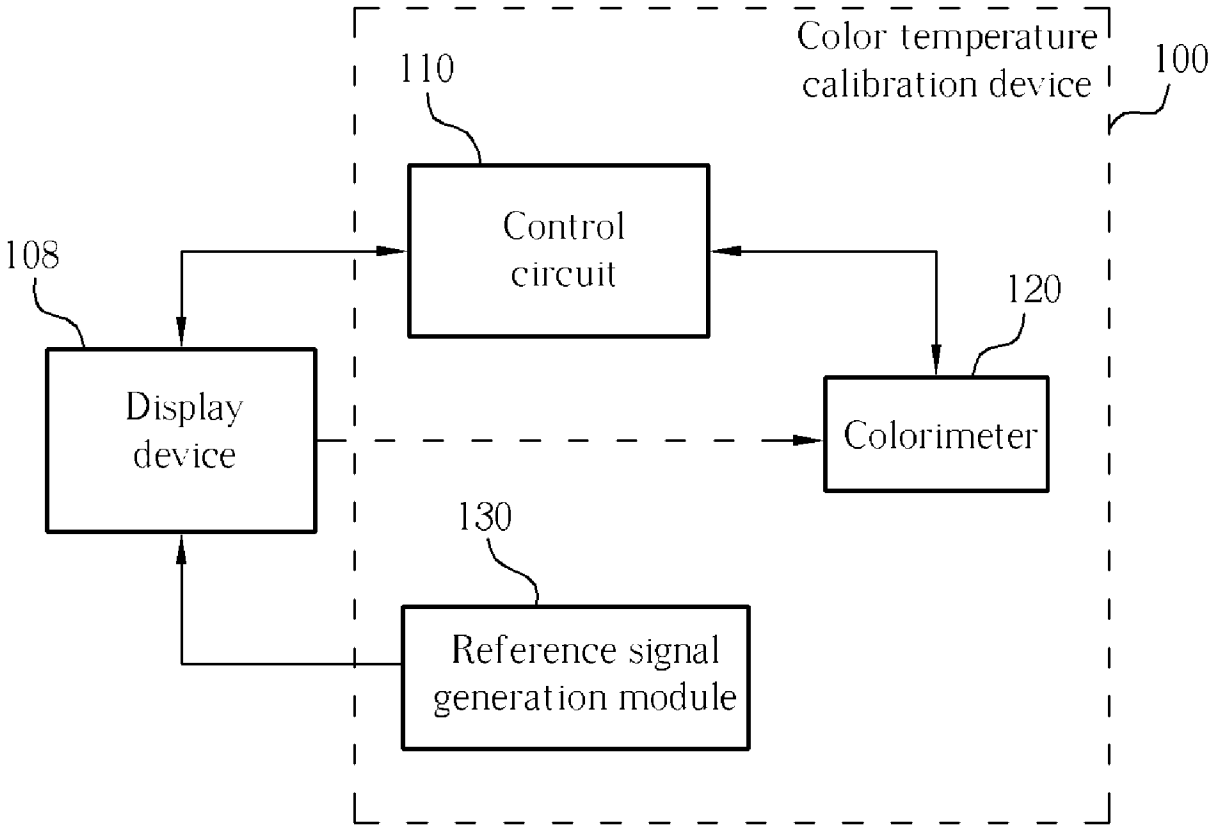
FIG. 1 is a diagram of a color temperature calibration device according to one embodiment of the present invention.

Please refer to FIG. 1. FIG. 1 is a diagram of a color temperature calibration device 100 according to one embodiment of the present invention. The color temperature calibration device 100 is utilized for calibrating the color temperature of a display device 108 according to a set of target chromaticity coordinate values, for example, the chromaticity coordinate (x=0.3127, y=0.3290) of the standard white color represented by the standard light source $D_{65}$. The color temperature calibration device 100 comprises a control circuit 110, a colorimeter 120, and a reference signal generation module 130, where the colorimeter 120 is well known in the art. According to this embodiment, the display device 108 is an LCD monitor.

The set of target chromaticity coordinate values mentioned above can be stored in a storage unit (not shown) in the color temperature calibration device 100. According to this embodiment, the storage unit is a register positioned in the control circuit 110. According to another embodiment of the present invention, the storage unit can be positioned outside the control circuit 110, for example, the storage unit could be positioned in a personal computer or a workstation.

Figure 2:
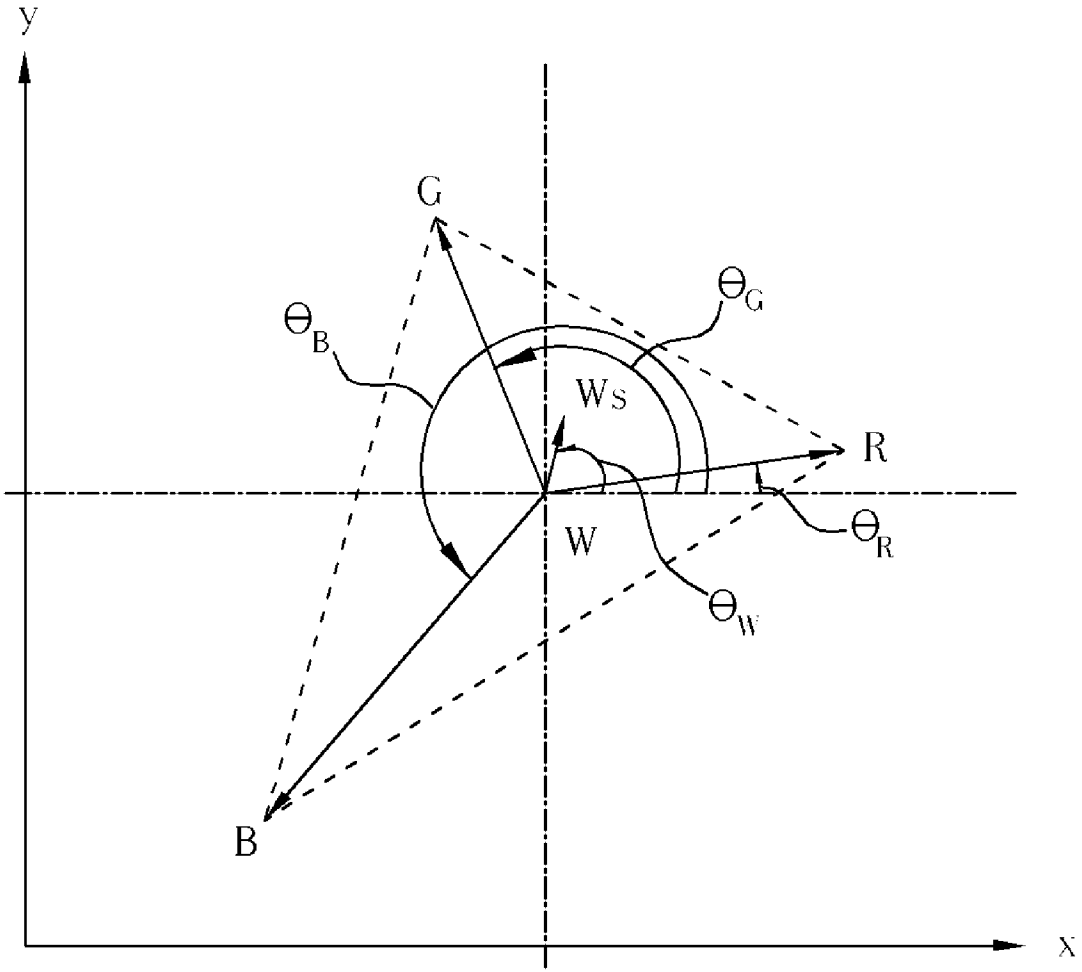
FIG. 2 illustrates color data utilized by a color temperature calibration method according to one embodiment of the present invention.

FIG. 2 illustrates a plurality of sets of color data (e.g., R, G, B, W, and Ws) utilized by a color temperature calibration method according to one embodiment of the present invention, where the color temperature calibration method can be applied to the color temperature calibration device 100 shown in FIG. 1, and can be implemented by utilizing the color temperature calibration device 100. According to this embodiment, each set of color data represents a set of chromaticity coordinate values (x, y), which is following the CIE1931 standard. The color data Ws represents the target color data for performing color temperature calibration by the color temperature calibration device 100, for example, the target color data Ws represents the standard white color under the standard light source $D_{65}$ mentioned above. The control circuit 110 of this embodiment may trigger the calorimeter 120, so the calorimeter 120 measures colors displayed by a plurality of display cells of the display device 108 to generate at least a set of measurement chromaticity coordinate values. In this embodiment, the color temperature calibration device 100 generates a plurality of sets of measured chromaticity coordinate values by utilizing the calorimeter 120 to perform the above-mentioned measurement on the display device 108, and respectively utilizes the sets of measured chromaticity coordinate values as the sets of color data W, R, G, and B shown in FIG. 2. According to this embodiment, the sets of color data R, G, B, W, and Ws can be stored in the storage unit for utilization by the control circuit 110.

The reference signal generation module 130 may generate at least one reference signal to drive the display cells to display colors, where the reference signal corresponds to an extreme value of a plurality of gray levels utilized while driving the display device. According to this embodiment, the plurality of gray levels comprise 256 gray levels from GL0 to GL255, and the extreme value mentioned above is the minimal value GL0 or the maximal value GL255 within the 256 gray levels GL0, GL1, . . . , GL255. In this embodiment, the reference signal generation module 130 generates a plurality of reference signals to drive the display cells, where the reference signals are red color signal, green color signal and blue color signal and respectively transmitted in a red color channel $C_R$, a green color channel $C_G$, and a blue color channel $C_B$ of the display device 108. And the reference signal generation module 130 can control the gray levels of each reference signal transmitted in the corresponded color channel.

If the gray levels respectively utilized by the color channels ($C_R$, $C_G$, $C_B$) are (GL255, GL0, GL0), the reference signal generation module 130 will drive the display cells to display pure red. In this situation, the calorimeter 120 measures colors displayed by a plurality of display cells of the display device 108 to generate a set of measurement chromaticity coordinate values as the color data R of this embodiment. If the gray levels respectively utilized by the color channels ($C_R$, $C_G$, $C_B$) are (GL0, GL255, GL0), the reference signal generation module 130 will drive the display cells to display pure green. In this situation, the colorimeter 120 measures colors displayed by a plurality of display cells of the display device 108 to generate a set of measurement chromaticity coordinate values as the color data G of this embodiment. Similarly, if the gray levels respectively utilized by the color channels ($C_R$, $C_G$, $C_B$) are (GL0, GL0, GL255), the reference signal generation module 130 will drive the display cells to display pure blue. In this situation, the colorimeter 120 measures colors displayed by a plurality of display cells of the display device 108 to generate a set of measurement chromaticity coordinate values as the color data B of this embodiment. In addition, if the gray levels respectively utilized by the color channels ($C_R$, $C_G$, $C_B$) are (GL255, GL255, GL255), the reference signal generation module 130 will drive the display cells to display pure white. In this situation, the colorimeter 120 measures colors displayed by a plurality of display cells of the display device 108 to generate a set of measurement chromaticity coordinate values as the color data W of this embodiment.

According to the chromaticity coordinate values of the color data Ws, W, R, G, and B (i.e. the sets of measurement chromaticity coordinate values in this embodiment), the control circuit 110 is capable of adjusting at least one gain value of the display device 108, for example, a gain value $D_R$ corresponding to the color channel $C_R$, a gain value $D_G$ corresponding to the color channel $C_G$, and a gain value $D_B$ corresponding to the color channel $C_B$. According to this embodiment, the control circuit 110 adjusts the gain values ($D_R$, $D_G$, $D_B$) respectively corresponding to the color channels ($C_R$, $C_G$, $C_B$) according to the following equations:

$$D_R'=(\theta_W-\theta_R)*(D_G+D_B)*F_R+D_R;$$

$$D_G'=(\theta_G-\theta_W)*(D_R+D_B)*F_G+D_G; \text{ and}$$

$$D_B'=(\theta_B-\theta_W)*(D_R+D_G)*F_B+D_B.$$

As shown in FIG. 2, $\theta_W$, $\theta_R$, $\theta_G$, and $\theta_B$ respectively represent angles of the color data Ws, R, G, and B with respect to the color data W; and $D_R'$, $D_G'$, and $D_B'$ in the equations mentioned above respectively represent the latest values of the gain values $D_R$, $D_G$, and $D_B$ after the adjustment. The control circuit 110 may control the display device 108, so the display device 108 displays colors according to the latest values of the gain values $D_R$, $D_G$, and $D_B$. As a result of repeatedly executing the operations mentioned above, the control circuit 110 derives the latest values of the color data W, R, G, and B step by step, calculates the latest values of the gain values $D_R$, $D_G$, and $D_B$, and controls the display device 108 to display colors according to the latest values of the gain values $D_R$, $D_G$, and $D_B$. In addition, $F_R$, $F_G$, and $F_B$ represent scaling functions or scaling parameters that are respectively utilized for adjusting the adjustment amounts corresponding to ($D_R'-D_R$), ($D_G'-D_G$), and ($D_B'-D_B$) in each time to control the speed and accuracy of the adjustment. Finally, the adjustment proceeding is completed until the difference of measurement chromaticity coordinate values and predetermined chromaticity coordinate values is smaller than predetermined threshold value, or the measurement chromaticity coordinate values is substantially equal to the predetermined chromaticity coordinate values.

According to another embodiment of the present invention, the control circuit does not need to measure the color data R, G, and B by utilizing the colorimeter. In this situation, the control circuit respectively utilizes three sets of predetermined chromaticity coordinate values as the color data R, G, and B, for example, three sets of chromaticity coordinate values respectively representing pure red, pure green, and pure blue (as defined according to the sRGB color space standards). In this embodiment, the color data W can still be derived by utilizing the calorimeter as mentioned above. In addition, the storage unit can be utilized for storing the chromaticity coordinate values representing the color data R, G, B, W, and Ws, for example, the set of target chromaticity coordinate values and the three sets of predetermined chromaticity coordinate values mentioned above. As a result, the control circuit may adjust the gain values ($D_R$, $D_G$, $D_B$) respectively corresponding to the color channels ($C_R$, $C_G$, $C_B$) according to the color data R, G, B, W, and Ws stored in the storage unit.

In a variation of this embodiment, as the three sets of predetermined chromaticity coordinate values representing pure red, pure green, and pure blue are known already and stored in a storage unit and further utilizing related equations of the sRGB color space standards, the control circuit of this variation may derive a set of chromaticity coordinate values representing pure white as the color data W. That is, in this variation, without utilizing the calorimeter to derive the color data W, the control circuit may directly adjust the gain values ($D_R$, $D_G$, $D_B$) respectively corresponding to the color channels ($C_R$, $C_G$, $C_B$).

According to another embodiment of the present invention, the control circuit generates the color data R, G, B, and/or W by utilizing a set of predetermined chromaticity coordinate values corresponding to a set of predetermined gray levels ($GL_R$, $GL_G$, $GL_B$) and by utilizing related equations of the sRGB color space standards, where any of the gray levels $GL_R$, $GL_G$, and $GL_B$ is not limited to be an extreme value of the plurality of gray levels (e.g. the 256 gray levels). In this embodiment, without utilizing the calorimeter to derive the color data R, G, B, and/or W, the control circuit may directly adjust the gain values ($D_R$, $D_G$, $D_B$) respectively corresponding to the color channels ($C_R$, $C_G$, $C_B$). In addition, the storage unit can be utilized for storing the set of target chromaticity coordinate values and the set of predetermined chromaticity coordinate values. As a result, the control circuit may adjust the gain values ($D_R$, $D_G$, $D_B$) respectively corresponding to the color channels ($C_R$, $C_G$, $C_B$) according to the set of target chromaticity coordinate values and the set of predetermined chromaticity coordinate values.

According to another embodiment of the present invention, the reference signal generation module 130 can be positioned in the display device 108. These modifications all fall within the scope of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A color temperature calibration method for calibrating the color temperature of a display device according to a set of target chromaticity coordinate values, the color temperature calibration method comprising:

utilizing a colorimeter for measuring colors displayed by a plurality of display cells of the display device to generate at least a set of measurement chromaticity coordinate values; and adjusting at least a first gain value of the display device according to the set of target chromaticity coordinate values, the set of measurement chromaticity coordinate values, a color angle of the set of measurement chromaticity coordinate values, and a second gain value and a third gain value of the display device;

wherein the first gain value corresponds to the color of a first color channel of the display device, and the second gain value and the third gain value respectively correspond to a second color channel and a third color channel of the display device; and the first color channel is one of the red color channel, green color channel and blue color channel;

wherein the first gain value of the display device is adjusted by calculating a difference between the color angle of the set of measurement chromaticity coordinate values and a color angle of the set of target chromaticity coordinate values.

2. The color temperature calibration method of claim 1, wherein the display cells display colors according to at least one reference signal, and the reference signal corresponds to an extreme value of a plurality of gray levels utilized while driving the display device.

3. The color temperature calibration method of claim 1, wherein the set of measurement chromaticity coordinate values correspond to a maximal value of a plurality of gray levels utilized by the first color channel, a minimal value of a plurality of gray levels utilized by a second color channel of the display device, and a minimal value of a plurality of gray levels utilized by a third color channel of the display device.

4. The color temperature calibration method of claim 3, wherein the measuring step further comprises measuring colors displayed by a plurality of display cells of the display device to generate another set of measurement chromaticity coordinate values corresponding to a maximal value of a plurality of gray levels utilized by the first color channel, a maximal value of a plurality of gray levels utilized by the second color channel, and a maximal value of a plurality of gray levels utilized by the third color channel, and the adjusting step further comprises:

adjusting the first gain value according to the other set of measurement chromaticity coordinate values.

5. The color temperature calibration method of claim 1, wherein the adjusting step further comprises:

adjusting the first gain value according to at least one set of predetermined chromaticity coordinate values.

6. A color temperature calibration method for calibrating the color temperature of a display device according to a set of target chromaticity coordinate values, the color temperature calibration method comprising:

displaying at least one color by a plurality of display cells of the display device, wherein the at least one color is composed of red color, green color and blue color;

measuring the at least one color to generate at least a set of measurement chromaticity coordinate values; and adjusting at least a first color gain value of the at least one color according to the set of target chromaticity coordinate values, the set of measurement chromaticity coordinate values, a color angle of the set of measurement chromaticity coordinate values, and a second color gain value of the at least one color, wherein the first color gain value of the at least one color and the second color gain value of the at least one color are corresponding to different color;

wherein the first color gain value of the at least one color is adjusted by calculating a difference between the color angle of the set of measurement chromaticity coordinate values and a color angle of the set of target chromaticity coordinate values.

7. The color temperature calibration method of claim 6, wherein the at least one color displayed by a plurality of display cells of the display device is an extreme value of a plurality of gray levels.

8. The color temperature calibration method of claim 6, wherein the adjusting step further comprises:

referring the color angle in the chromaticity coordinate to adjust the first color gain value of the at least one color without converting to/from color spaces.

9. The color temperature calibration method of claim 6, wherein the adjusting step further comprises:

adjusting the first color gain value of the at least one color until the difference between the set of target chromaticity coordinate values and the set of measurement chromaticity coordinate values is smaller than a threshold value.

10. The color temperature calibration method of claim 6, wherein the adjusting step further comprises:

adjusting the first color gain value of the at least one color according to the at least one set of a predetermined chromaticity coordinate values.

11. The color temperature calibration method of claim 6, wherein the adjusting step further comprises:

adjusting the first color gain value of the at least one color, a second color gain value of the at least one color and a third color gain value of the at least one color until the color complies with sRGB color space standards.

12. The color temperature calibration method of claim 6 further comprises:

storing the set of target chromaticity coordinate values in a storage unit.

13. A color temperature calibration device for calibrating the color temperature of a display device according to a set of target chromaticity coordinate values, the color temperature calibration device comprising:

a colorimeter for measuring colors displayed by a plurality of display cells of the display device to generate at least a set of measurement chromaticity coordinate values; and a control circuit, coupled to the colorimeter and the display device, for adjusting at least a first gain value of the display device according to the set of target chromaticity coordinate values, the set of measurement chromaticity coordinate values, a color angle of the set of measurement chromaticity coordinate values, and a second gain value and a third gain value of the display device;

wherein the first gain value corresponds to the color of a first color channel of the display device, and the second gain value and the third gain value respectively correspond to a second color channel and a third color channel of the display device; and the first color channel is one of the red color channel, green color channel and blue color channel;

wherein the first gain value of the display device is adjusted by calculating a difference between the color angle of the set of measurement chromaticity coordinate values and a color angle of the set of target chromaticity coordinate values.

14. The color temperature calibration device of claim 13, further comprising:

a reference signal generation module, coupled to the display device, for generating at least one reference signal to drive the display cells to display colors;

wherein the reference signal corresponds to an extreme value of a plurality of gray levels utilized while driving the display device.

15. The color temperature calibration device of claim 14, wherein the reference signal generation module is positioned in the display device.

16. The color temperature calibration device of claim 13, wherein the set of measurement chromaticity coordinate values correspond to a maximal value of a plurality of gray levels utilized by the first color channel, a minimal value of a plurality of gray levels utilized by a second color channel of the display device, and a minimal value of a plurality of gray levels utilized by a third color channel of the display device.

17. The color temperature calibration device of claim 13, wherein the control circuit adjusts the first gain value according to the color angle in the chromaticity coordinate without converting to/from color spaces.

* * * * *